US011596955B2

(12) United States Patent
Byhmer et al.

(10) Patent No.: US 11,596,955 B2
(45) Date of Patent: Mar. 7, 2023

(54) CENTRIFUGAL SEPARATOR FOR SEPARATING A LIQUID MIXTURE, AND METHOD THEREFOR

(71) Applicant: Tetra Laval Holdings & Finance S.A., Pully (CH)

(72) Inventors: Fredrik Byhmer, Furulund (SE); Erwin Kaschmieder, Tormestorp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 313 days.

(21) Appl. No.: 16/956,600

(22) PCT Filed: Dec. 17, 2018

(86) PCT No.: PCT/EP2018/085102
§ 371 (c)(1),
(2) Date: Jun. 21, 2020

(87) PCT Pub. No.: WO2019/121439
PCT Pub. Date: Jun. 27, 2019

(65) Prior Publication Data

US 2021/0031216 A1 Feb. 4, 2021

(30) Foreign Application Priority Data

Dec. 22, 2017 (EP) ..... 17209952

(51) Int. Cl.
*B04B 1/14* (2006.01)
*B04B 1/08* (2006.01)
(Continued)

(52) U.S. Cl.
CPC ..... *B04B 1/14* (2013.01); *B04B 1/08* (2013.01); *B04B 11/04* (2013.01); *B04B 13/00* (2013.01); *B04B 15/08* (2013.01)

(58) Field of Classification Search
CPC .. B04B 1/14; B04B 1/08; B04B 11/04; B04B 15/08; B04B 1/04; B04B 13/00
See application file for complete search history.

(56) References Cited

U.S. PATENT DOCUMENTS 6,530,871 B1 * 3/2003 Mackel ..... B04B 11/04 494/56
11,420,215 B2 * 8/2022 Rotermund ..... B04B 1/16
(Continued)

FOREIGN PATENT DOCUMENTS

DE 39 24 372 C1 11/1990
DE 10 2012 106648 A1 1/2014
(Continued)

OTHER PUBLICATIONS

International Search Report for corresponding Application No. PCT/EP2018/085102, dated Mar. 18, 2019.
(Continued)

*Primary Examiner* — Charles Cooley
(74) *Attorney, Agent, or Firm* — Renner, Otto, Boisselle & Sklar, LLP

(57) ABSTRACT

A method of operating a centrifugal separator is provided. The method includes supplying a liquid mixture to be separated to the inlet of the centrifugal separator, separating the liquid mixture into at least one separated liquid component and a separated sludge component, discharging at least one separated liquid component from at least one liquid outlet of the centrifuge rotor, removing gas from a space surrounding a centrifuge rotor of the separator, to obtain a sub-atmospheric pressure in the space, and discharging a separated sludge component from at least one sludge outlet arranged at a periphery of the centrifuge rotor to the space which is delimited by a frame, wherein the discharging is performed when the sub-atmospheric pressure in the space
(Continued)

surrounding the centrifuge rotor is within a preset pressure interval ΔP.

14 Claims, 4 Drawing Sheets

(51) Int. Cl.
*B04B 11/04* (2006.01)
*B04B 15/08* (2006.01)
*B04B 13/00* (2006.01)

(56) References Cited

U.S. PATENT DOCUMENTS

2012/0040816 A1* 2/2012 Thorwid ..... B04B 11/02 494/13
2015/0051059 A1* 2/2015 Mackel ..... B04B 15/02 494/37
2015/0175439 A1* 6/2015 Quiter ..... B04B 7/02 210/403
2021/0031216 A1* 2/2021 Byhmer ..... B04B 1/08

FOREIGN PATENT DOCUMENTS

EP 3501662 A1 * 6/2019
WO 2010/101524 A2 9/2010

OTHER PUBLICATIONS

Extended European Search Report for corresponding Application No. 17209952.5, dated Jul. 3, 2018.

* cited by examiner

CENTRIFUGAL SEPARATOR FOR SEPARATING A LIQUID MIXTURE, AND METHOD THEREFOR

TECHNICAL FIELD

The invention relates to the field of centrifugal separators, and especially to the field of operating centrifugal separators.

BACKGROUND

Today centrifugal separation is used in the food industry for separation of liquids or for separation of solids from liquids. Separation is achieved by introducing the liquid to be processed in a rotating bowl and collecting separated phases e.g. by means of different outlets arranged at the periphery of the bowl and close to the rotational axis.

A centrifugal separator of today may consume much energy, and a part is lost e.g. at the contact between rotating parts and at the contact between the rotating centrifuge rotor with the surrounding gas. These losses may cause unnecessarily high energy consumption of the centrifugal separator.

Energy losses may further increase the temperature of rotating and adjacent parts, which may be undesirable if e.g. fluids sensitive to high temperature are to be separated. In order to decrease the temperature of a separator, a cooling device in the form of a water-cooled casing may be arranged in the separator.

In order to overcome problems with high energy consumption, it is known e.g. from WO10101524 to create a sub-atmospheric pressure around the rotating centrifuge rotor during operation. The removal of gas due to the creation of the sub-atmospheric pressure reduces friction losses during operation.

However, there is still the need for improved methods for operating a centrifugal separator.

SUMMARY

It is an object of the invention to at least partly overcome one or more limitations of the prior art. In particular, it is an object to provide a method of operating a centrifugal separator that decreases friction losses during operation.

Further, it is an object to provide a method in which the variations in sludge discharge volume between discharge from a centrifugal separator is decreased.

In one aspect of the invention, this is achieved by a method of operating a centrifugal separator comprising

- supplying a liquid mixture to be separated to the inlet of the centrifugal separator, the separator comprising
  - a frame which delimits a space that is sealed relative the surroundings of the frame and in which a centrifuge rotor is arranged, and
  - a drive member configured to rotate the centrifuge rotor in relation to the frame around an axis of rotation (X), wherein the centrifuge rotor encloses a separation chamber that is arranged to receive the supply of liquid mixture to be separated via the inlet,
- separating the liquid mixture into at least one separated liquid component and a separated sludge component;
- discharging at least one separated liquid component from at least one liquid outlet of the centrifuge rotor;
- removing gas from the space surrounding the centrifuge rotor to obtain a sub-atmospheric pressure in the space; and

- discharging a separated sludge component from at least one sludge outlet 9 arranged at the periphery of the centrifuge rotor to the space delimited by the frame, wherein the discharging is performed when the sub-atmospheric pressure in the space surrounding the centrifuge rotor is within a preset pressure interval ΔP.

Thus, the inventors have found that the sludge volume discharged from the separator can be strongly affected by the actual pressure around the centrifugal rotor when running the separator at sub-atmospheric pressure. A lower pressure around the centrifugal rotor results in a larger discharge, and the inventors have found that e.g. a 5 kPa difference in the pressure around the centrifugal rotor may lead to a difference of approximately 2 kg in discharge volume.

By controlling the pressure around the centrifugal rotor at start of discharge, the operability of the separation process increases, i.e. an operator may have a better chance of predicting the amount of sludge that will be discharge at each discharge, which in turn may lead to lower product losses during separation. Thus, the method is advantageous in variations in the sludge discharge volume from the centrifugal separator can be decreased by initiating the discharge when the pressure around the centrifugal rotor is within a certain pressure interval.

As an example, a difference between two end-values defining the pressure interval ΔP is less than 3 kPa, or less than 1 kPa, or less than 0.5 kPa.

The preset pressure interval ΔP may thus be formed around a set point pressure $P_{set}$. The pressure $P_{set}$. may be around 30 kPa. Consequently, the desired sub-atmospheric pressure during discharge may be $P_{set}$ and discharge may thus be initiated when the pressure around the centrifugal rotor is at or close to the set point pressure $P_{set}$, i.e. when the sub-atmospheric pressure is within the preset pressure interval ΔP.

The method may comprise measuring the sub-atmospheric pressure in the space surrounding the centrifuge rotor and the discharging of a separated sludge component from at least one sludge outlet being initiated when the measured sub-atmospheric pressure is within the preset pressure interval ΔP.

Based on the measurements, the actual sub-atmospheric pressure may be regulated or adjusted until it is within the preset pressure interval ΔP.

Thus, measuring of the sub-atmospheric pressure in the space may also comprise adjusting the sub-atmospheric pressure in the space surrounding the centrifuge rotor if the measured sub-atmospheric pressure is outside preset pressure interval ΔP, wherein the adjusting is performed by removing gas from the space surrounding the centrifuge rotor until the measured sub-atmospheric pressure is within preset pressure interval ΔP.

As a second aspect of the invention, there is provided a centrifugal separator for separating a liquid mixture, the separator comprising

- a frame which delimits a space that is sealed relative the surroundings of the frame and in which a centrifuge rotor is arranged,
- a drive member configured to rotate the centrifuge rotor in relation to the frame around an axis of rotation (X), wherein the centrifuge rotor 4 encloses a separation chamber that is arranged to receive the supply of liquid mixture to be separated via an inlet and in which separation of the liquid mixture takes place during operation,
- at least one liquid outlet for discharging a separated liquid phase, at least one sludge outlet arranged at the periphery of the centrifuge rotor for intermittently discharging a separated sludge component to the space delimited by the frame, a pump device arranged for removing gas from the space during operation, a measuring unit arranged to measure a sub-atmospheric pressure P, in the space during operation, and a control unit configured to receive a value of the sub-atmospheric pressure $P_x$ from the measuring unit and to initiate discharge of the separated sludge component via the at least one sludge outlet when $P_x$ is within a preset pressure interval $\Delta P$.

The centrifugal separator may thus be used in the method according to the first aspect above Still other objectives, features, aspects and advantages of the invention will appear from the following detailed description as well as from the drawings.

DRAWINGS

Embodiments of the invention will now be described, by way of example, with reference to the accompanying schematic drawings.

Figure 3:
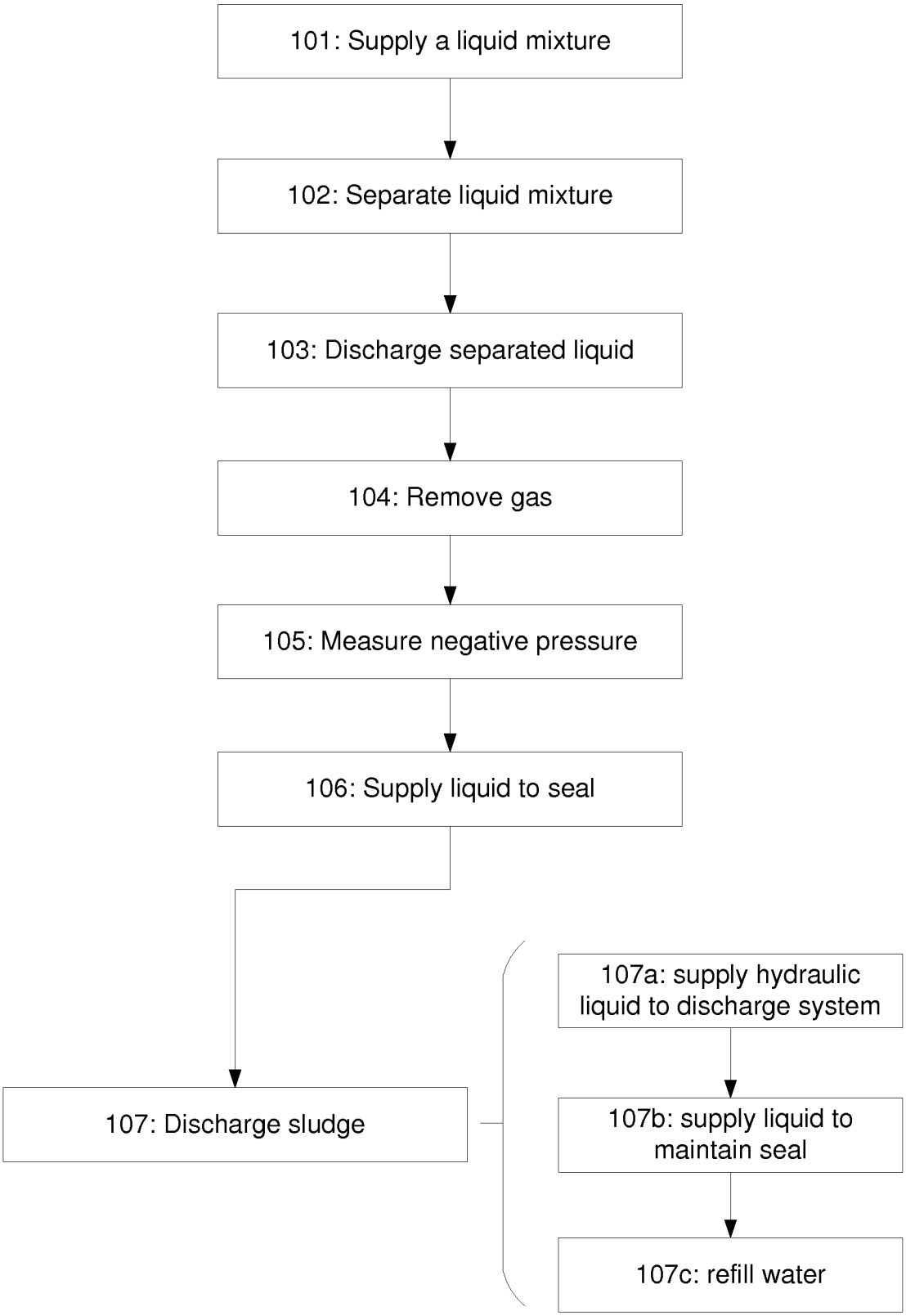

FIG. 3 schematically illustrates a method of the present disclosure.

Figure 4:
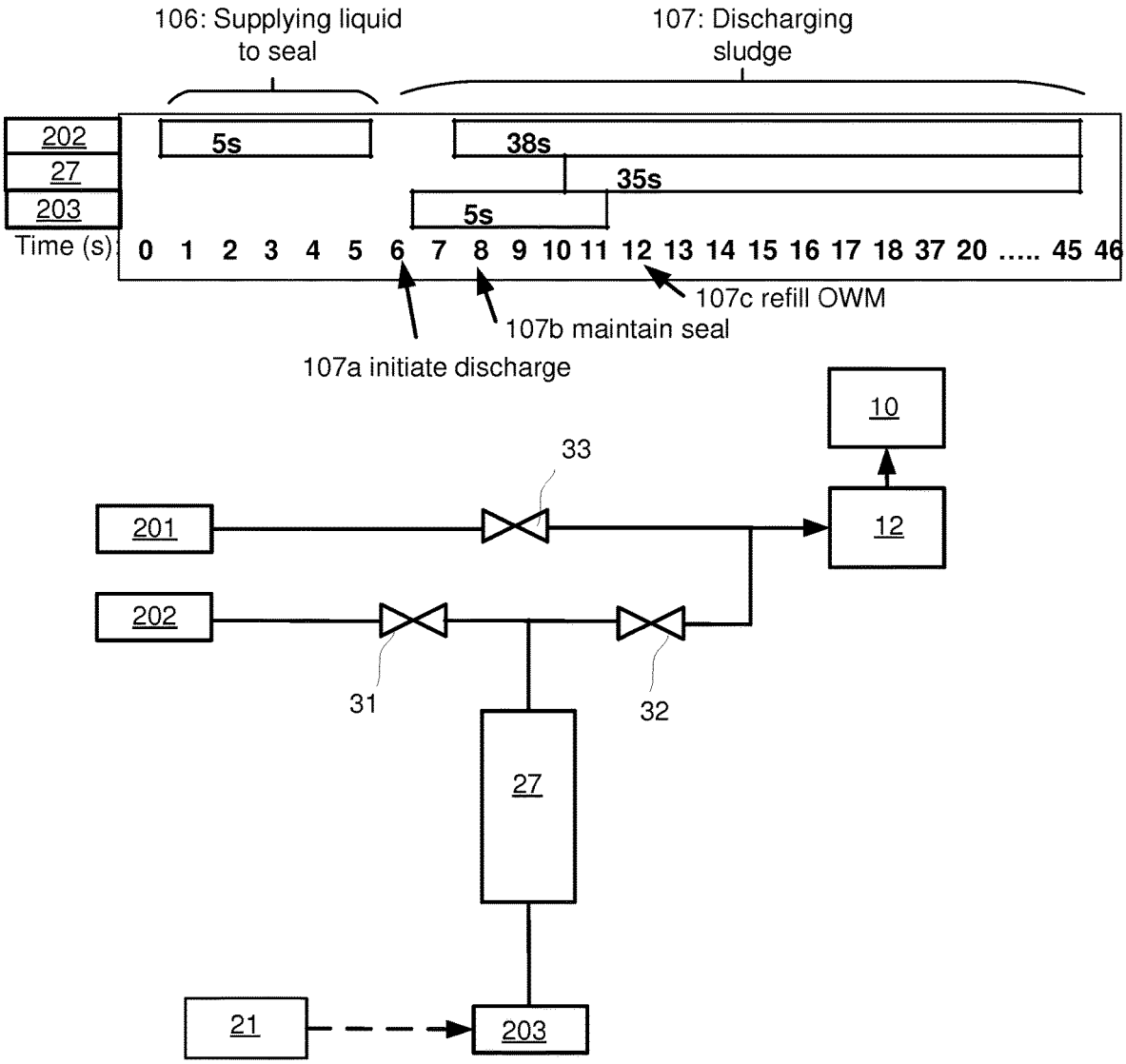

FIG. 4 illustrates a discharge sequence.

DETAILED DESCRIPTION

Embodiments of the invention will now be described more fully hereinafter with reference to the accompanying drawings, in which some, but not all, embodiments of the invention are shown. The invention may be embodied in many different forms and should not be construed as limited to the embodiments set forth herein.

Any suitable centrifugal separator capable of providing a sub-atmospheric pressure around its rotating centrifuge rotor may be used with the method of the present invention.

Figure 1:
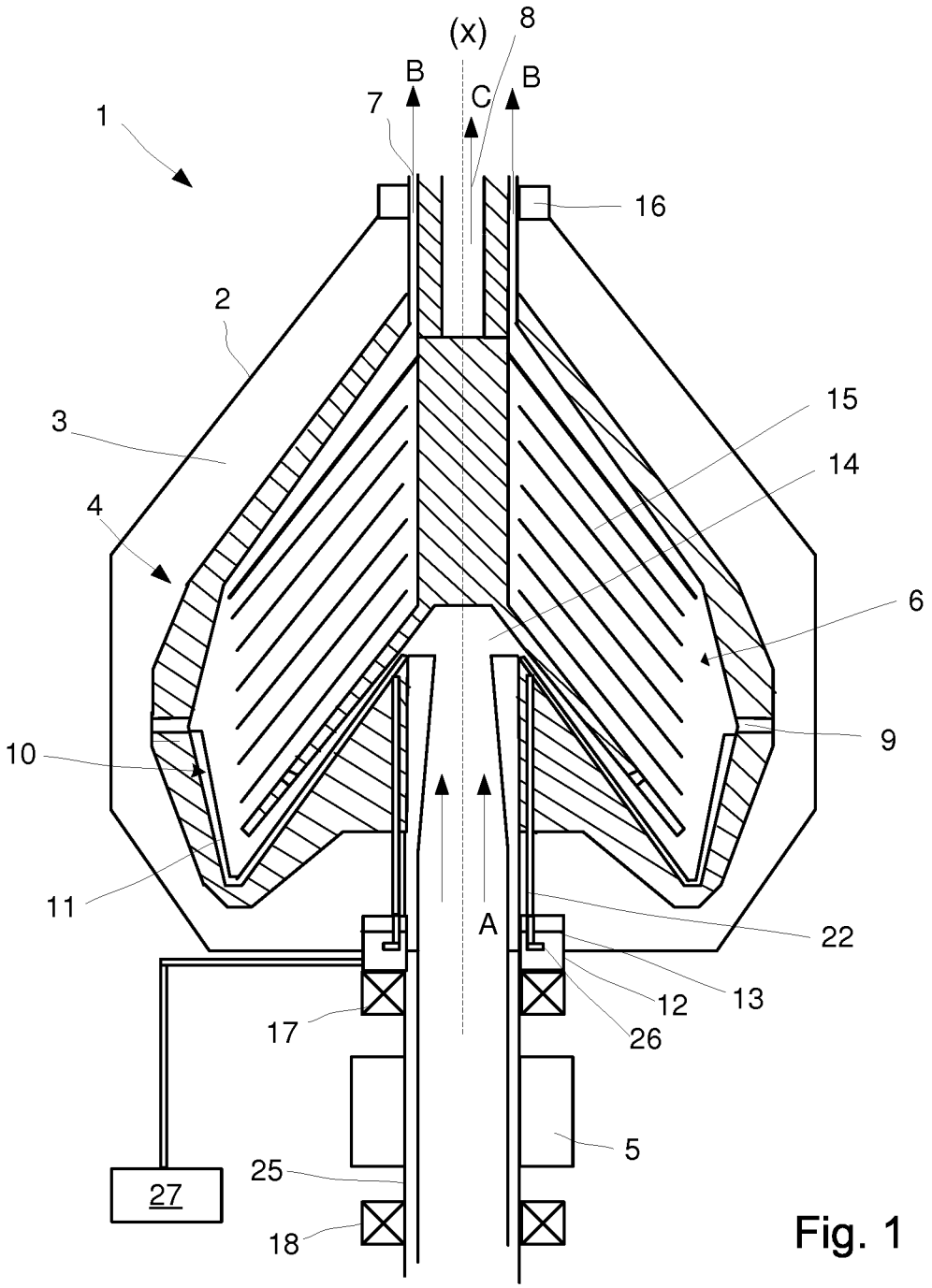
FIG. 1 is a cross-sectional view of a centrifugal separator.

With reference to FIG. 1 an exemplary centrifugal separator 1 is illustrated. The centrifugal separator 1 is for separating a liquid mixture, and comprises a frame 2 which delimits a space 3 that is sealed relative the surroundings of the frame 2 and in which a centrifuge rotor 4 is arranged. The separator 1 further comprises a drive member 5 configured to rotate the centrifuge rotor 4 in relation to the frame 2 around an axis of rotation (X). The centrifuge rotor 4 encloses a separation chamber 6 that is arranged to receive the supply of liquid mixture to be separated via an inlet 14 and in which separation of the liquid mixture takes place during operation.

The separator 1 further comprises a hollow spindle 25 (partly shown) onto which the centrifuge rotor 4 is arranged around the axis of rotation (X) by means of upper bearing 17 and lower bearing 18. Thus, the hollow spindle 25 is arranged to be rotated during operation of the centrifugal separator 1. During operation, the spindle 25 forms a rotating shaft.

The drive member 5 is arranged for transmitting torque to the spindle 25 and comprises an electrical motor having a rotor and a stator. Advantageously, the rotor of the electrical motor may be provided on or fixed to the spindle of the rotating part. Alternatively, the drive member may be provided beside the spindle and rotate the rotating part by a suitable transmission, such as a belt or a gear transmission.

The centrifuge rotor 4 encloses, or forms within itself, the separation chamber 6 in which a stack 15 of separation discs is arranged centrally around the axis of rotation (X). The separation discs of the stack 15 form surface enlarging inserts in the separation chamber 6. Each separation disc may have the form of a truncated cone, i.e. the stack may a stack of frustoconical separation discs. The discs may also be axial discs arranged around the axis of rotation.

At least one liquid outlet 7 and 8 for discharging a separated liquid phase is arranged on the upper part of the separator 1. In this case, the separator 1 comprises a first liquid outlet 7 for discharging a first separated liquid phase and a second liquid outlet 8 for discharging a second separated liquid phase. The first separated liquid phase has a higher density than the second separated liquid phase and consequently, the first liquid outlet 7 is arranged at a larger radius than the second liquid outlet 8.

The separator 1 is in this embodiment fed from the bottom via the spindle 25, i.e. liquid mixture to be separated is led via spindle 25 arranged axially below the centrifuge rotor 4 to inlet 14. However, it is to be understood that the centrifugal separator 1 may be arranged to be fed from the top, e.g. via a stationary inlet pipe that is arranged to supply the liquid mixture to be separated to the inlet 14. In such case, the inlet 14 and liquid outlets could all be arranged at the top of the separator 1. The separator 1 has channels leading from the interspaces between the disks in the stack 15 and towards the outlet 8 for the lower density liquid.

The separator 1 further comprises at least one sludge outlet 9 arranged at the periphery of the centrifuge rotor 4 for intermittently discharging a separated sludge component to the space 3 delimited by the frame 2.

The at least one sludge outlet 9 takes the form of a set of ports arranged at the radially outer periphery of the separation chamber 6 for intermittent discharge of a sludge component of the liquid mixture. The opening of the outlets 9 is controlled by means of an intermittent discharge system 10, which comprises a sliding bowl bottom 11 that is movable between a closed position, in which the sludge outlets 9 are closed, and an open position, in which the sludge outlets 9 are open. Keeping the sliding bowl bottom 11 in a closed position may be effected by supplying hydraulic fluid via a channel 22 to a closing chamber (not shown) between the sliding bowl bottom 11 and the frame 2 in order to hold the sliding bowl bottom 11 in the closed position. The intermittent discharge system 10 may further comprise an opening chamber, to which hydraulic fluid is supplied when to change the sliding bowl bottom 11 to its open position. The supply of hydraulic fluid may be aided by a paring disc 26 arranged in a paring chamber 12. The paring chamber 12 may be located axially below the centrifuge rotor 4. In this case, also a liquid seal 13 is arranged within the paring chamber 12 for sealing the space 3 against the surroundings of the frame 2.

Consequently, in embodiments, the separator 1 is comprising an intermittent discharge system 10 for discharging the separated sludge component via the at least one sludge outlet 9, wherein a seal 13 for sealing the space 3 is arranged in a paring chamber 12 of the centrifugal separator 1 during operation, and the paring chamber 12 comprises at least one paring disc 26 for supplying hydraulic fluid for operating the intermittent discharge system 10.

Operating the intermittent discharge system 10 may comprise opening and/or closing the peripheral ports 9.

The supply of hydraulic fluid to the paring chamber 26 may originate from an operating water module (OWM) 27. The OWM 27 may be arranged to supply hydraulic fluid, generally in form of water, to the paring chamber 12 and to the intermittent discharge system 10.

Figure 2:
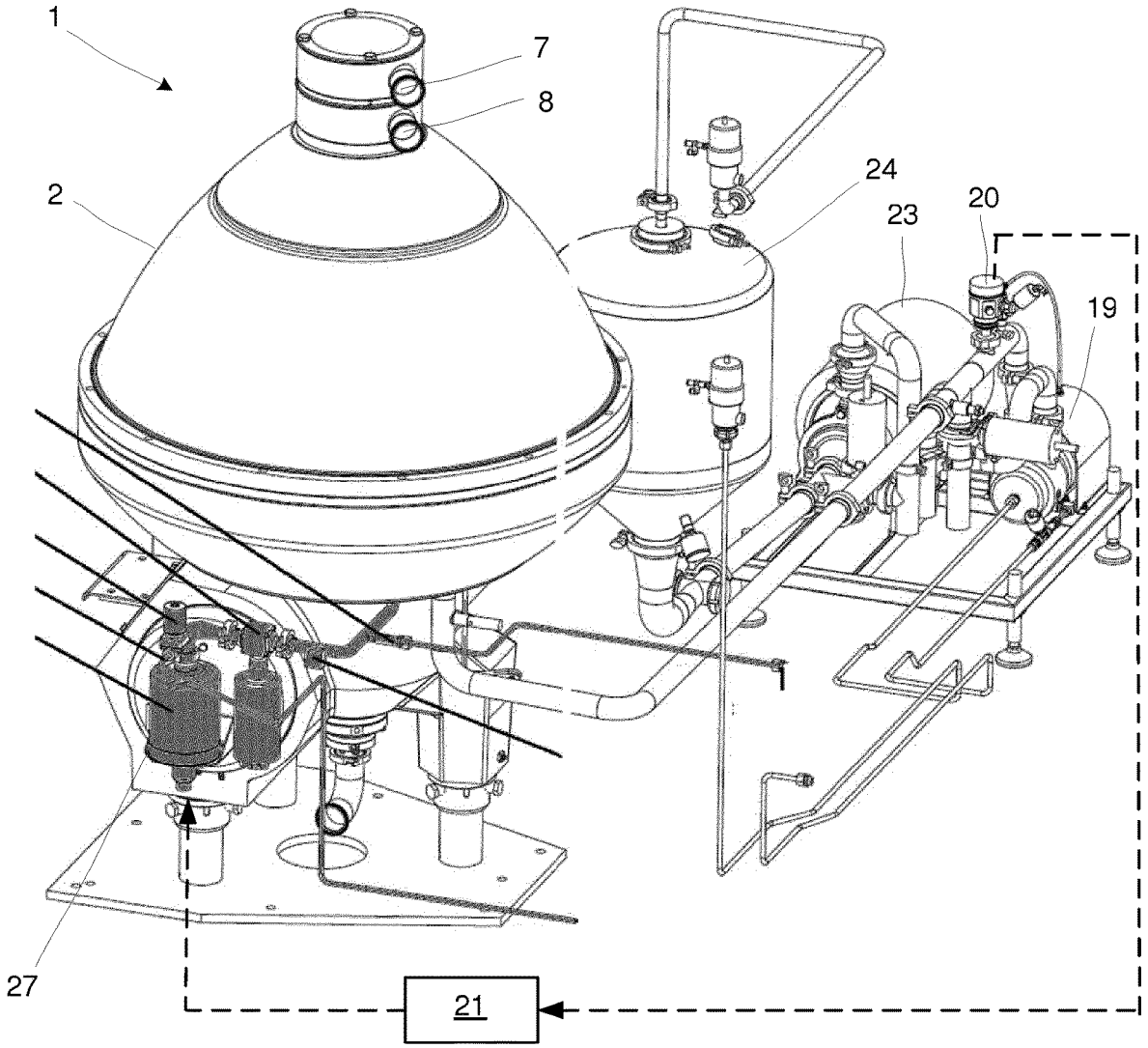
FIG. 2 is a perspective view of a centrifugal separator.

As seen in FIG. 2, the centrifugal separator 1 further comprises a pump device 19 arranged for removing gas from the space 3 during operation of the separator 1. The pump device 19 may e.g. be in the form of a water-filled liquid ring pump or a lamella pump. The pump device 19 is in this embodiment a vacuum pump 19 that operates in an active mode, in which the sub-atmospheric pressure in the separator 1 is reduced to P1, and an inactive mode, in which the sub-atmospheric pressure increases to P2. During the active mode, the pressure may also be kept at P1.

The pressure in the space 3 and around the rotor may thus fluctuate between a lower sub-atmospheric pressure P1 and a higher sub-atmospheric pressure P2, depending if the pump 19 is in the active or inactive mode. The active mode of the pump 19 may be when the pump 19 is running and the inactive mode may be when the pump 19 is off, and switch from the inactive to the active mode may comprise turning on the pump 19.

Thus, the space 3 is sealed for the surroundings of the frame such that the centrifuge rotor 4 may rotated in a surrounding having sub-atmospheric pressure, which reduces energy consumption of the separator 1. The space 3 is sealed by means of upper seal 16 and the liquid seal 13 arranged within the paring chamber 12. At least one of the seals sealing the space 3 may be a hermetic seal. Thus, the upper seal 15 may be mechanically hermetically sealed.

There is further a measuring unit 20 arranged to measure a sub-atmospheric pressure $P_x$ in the space 3 during operation. The measuring unit 20 is arranged for communication with a control unit 21, which may regulate the intermittent discharge system 10 based on information received from the measuring unit. Thus, the control unit 21 is configured to receive a value of the sub-atmospheric pressure $P_x$ from the measuring unit 20 and, initiate discharge of the separated sludge component via the at least one sludge outlet 9 when P, is within a preset pressure interval ΔP.

The control unit 21 may comprise a processor and an input/output interface for communicating with the measuring unit 20 and the intermittent discharge system 10 or the OWM 27 that is coupled to the intermittent discharge system 10. Thus, the processor may be adapted to access data from the control unit and generate and transmit control signals to the intermittent discharge system 10, e.g. by controlling start of supply of hydraulic fluid from the operating water module OWM 27 to the paring chamber 12.

The control unit 21 is further configured for comparing the measured sub-atmospheric pressure $P_x$ with a preset pressure interval ΔP and for regulating the intermittent discharge system 10 based on the comparison. Thus, a processor in the control unit may be adapted for comparing the received value from the measuring unit 20 with reference values.

The centrifugal separator 1 comprises a device, in this case a sludge pump 23, for removing discharged sludge from the space 3 delimited by the frame 2, and a vessel 24 in the form of a cyclone connected to the space 3 for collecting discharged sludge before it is removed by the pump 23. This vessel 24 is adapted to collect sludge and any liquid that has been discharged from the sludge outlets 9. The vessel 24 is further connected to the sludge pump 23 for further removal of sludge and liquid present in the vessel 24.

A method of the present disclosure is further illustrated in FIG. 3. During operation of the centrifugal separator 1 shown in FIGS. 1 and 2, the rotor 3 is caused to rotate by torque transmitted from the drive motor 5 to the spindle 25.

The method comprises supplying 101 a liquid mixture to be separated to the inlet 14 of the centrifugal separator. The liquid mixture is supplied via hollow spindle 25, as illustrated by arrow "A" in FIG. 1. The method further comprises separating 102 the liquid mixture into at least one separated liquid component and a separated sludge component, which is performed in the separation chamber 6.

Further, the method comprises discharging 103 at least one separated liquid component from at least one liquid outlet 7,8 of the centrifuge rotor 4. The discharging of at least one separated liquid phase may comprise discharging a separated heavy phase in liquid outlet 7, as illustrated by arrow "B" in FIG. 1, and discharging a liquid light phase via liquid outlet 8, as illustrated by arrow "C" in FIG. 1.

The method also comprises removing 104 gas from the space 3 surrounding the centrifuge rotor 4 to obtain a sub-atmospheric pressure in the space 3 and discharging 107 a separated sludge component from at least one sludge outlet 9 arranged at the periphery of the centrifuge rotor 4 to the space 3 delimited by the frame 2, wherein the discharging 107 is performed when the sub-atmospheric pressure in the space 3 surrounding the centrifuge rotor 4 is within a preset pressure interval ΔP.

Thus, the actual discharge of the sludge component is performed only when the sub-atmospheric pressure is within the preset pressure interval ΔP. This decreases the risk of large variations in discharged sludge volume between each discharge. The removing 104 of gas from the space 3 surrounding the centrifuge rotor 4 and the discharging 107 of a separated sludge component may thus be repeated, and the volume of the discharged sludge component is, between each discharge, kept within 15%, such as within 10%, of a mean volume of discharged sludge component.

The variations in discharge volume may be regulated by selecting the preset pressure interval ΔP. Thus, a smaller ΔP may lead to smaller variations in discharge volume, whereas a larger ΔP may increase the variations in discharge volume. As an example, a difference between two end-values defining the pressure interval ΔP is less than 3 kPa, or less than 1 kPa, or less than 0.5 kPa.

The preset pressure interval ΔP may thus be formed around a set point pressure $P_{set}$. The pressure $P_{set}$ may be around 30 kPa, or have a value from 25 kPa to 35 kPa. Consequently, the desired sub-atmospheric pressure during discharge may be $P_{set}$. and discharge may thus be initiated when the pressure around the centrifugal rotor is at or close to the set point pressure $P_{set}$, i.e. when the sub-atmospheric pressure is within the preset pressure interval ΔP. For illustration, when ΔP is less than 3 kPa and when the pressure $P_{set}$ is around 30 kPa, then the end points defining ΔP is 28.5 kPa respectively 31.5 kPa.

Furthermore, the measuring 105 the sub-atmospheric pressure in the space 3 surrounding the centrifuge rotor 4 and the discharging 107 of a separated sludge component from at least one sludge outlet 9 being initiated when the measured sub-atmospheric pressure is within the preset pressure interval ΔP.

Consequently, the method may also include the actual measuring of the sub-atmospheric pressure. The pressure may be measured continuously or at discrete time points, depending on the application and the common frequency at which sludge is discharged for a specific application.

The measuring 105 of the sub-atmospheric pressure in the space 3 may also comprise adjusting the sub-atmospheric pressure in the space 3 surrounding the centrifuge rotor 4 if the measured sub-atmospheric pressure is outside preset pressure interval ΔP, wherein the adjusting is performed by removing 104 gas from the space 3 surrounding the centrifuge rotor 4 until the measured sub-atmospheric pressure is within preset pressure interval ΔP.

Thus, the measuring 105 may be used in a feedback operation to regulate the sub-atmospheric pressure in the space 3 based on the measured sub-atmospheric pressure, such as regulating the sub-atmospheric pressure to a set point pressure $P_{set}$ within the preset pressure interval ΔP. Regulation and removing 104 of gas is performed by operating the vacuum pump 19. This pump operates in an active mode, in which the sub-atmospheric pressure is reduced to P1, and an inactive mode, in which the sub-atmospheric pressure increases to P2.

Thus, the step of removing 104 gas comprises removing gas such that the sub-atmospheric pressure fluctuates between a first lower sub-atmospheric pressure value P1 and a second higher sub-atmospheric pressure value P2, and wherein the preset pressure interval ΔP is smaller than the interval between the first P1 and second P2 pressure values.

For example, the lower first lower sub-atmospheric pressure value P1 may be about 28 kPa and the second higher sub-atmospheric pressure value P2 may be about 32 kPa.

Switching of the vacuum pump 19 to its active mode, measuring the sub-atmospheric pressure in the space 3 and, if needed, adjusting the sub-atmospheric pressure and thereafter initiating discharge may be performed in sequence. Thus, the measuring 105 of the sub-atmospheric pressure in the space 3 surrounding the centrifuge rotor 4 and the discharging 107 of a separated sludge component may initiated within a predetermined time interval Δt after the vacuum pump 19 has been switched to its active mode, and wherein Δt<10 s, such as Δt<5 s.

To secure that any liquid seals used for sealing the space 3 to the surroundings of the frame are capable of withholding as much as possible of their sealing function during discharge, i.e. so that the sub-atmospheric pressure is kept in space 3, liquid may be supplied to the seal before discharge, such as to a liquid seal 13 within paring chamber 12. Thus, in embodiments, the method is comprising supplying 106 liquid to a seal 13 that seals the space 3 relative the surroundings of the frame 2 before the discharging 107 of a separated sludge component.

The inventors have found that the supply of liquid to the seal may increase the pressure in the space 3, e.g. due to evaporation of liquid due to the low pressure. Thus, the supply of liquid to a liquid seal may lead to an increase in pressure around centrifugal rotor. Therefore, the inventors have found that it is advantageous to measure and adjust the pressure in the space during the period in which liquid is supplied to a liquid seal. Thus, in embodiments the measuring 105 of the sub-atmospheric pressure in the space 3 and adjusting the sub-atmospheric pressure in the space 3 surrounding the centrifuge rotor 4 if the measured sub-atmospheric pressure is outside preset pressure interval ΔP are performed during supplying 106 liquid to the liquid seal 13 that seals the space 3 relative the surroundings of the frame.

The centrifugal separator 1 comprises in this embodiment a liquid seal 13 within the paring chamber 12 that is used in the supply of operating liquid to the intermittent discharge system 10. Thus, in embodiments, the centrifugal separator 1 comprises an intermittent discharge system 10 for performing the step of discharging 107 a separated sludge component, and wherein the seal 13 is a liquid seal arranged in a paring chamber 12 of the centrifugal separator 1, wherein the paring chamber 12 further comprises at least one paring disc 26 for supplying hydraulic fluid for operating the intermittent discharge system 10.

A discharge sequence is illustrated in FIG. 4. The intermittent discharge system 10 may receive operating water of low pressure via supply system 201, operating water of high pressure via supply system 202 and water from the operating water module OWM 27, all supplied via paring chamber 12. A non-return valve 33 is arranged in the line for supplying operating water of low pressure, a diaphragm valve 31 is arranged in the line for supplying water of high pressure 202 and a ball valve 32 is arranged downstream of the OWM 27 to regulate flow to the paring chamber 12 from both the OWM 27 and the supply line for water of high pressure 202.

During normal operation of the separator 1, e.g. at time<0 s in the timeline of FIG. 4, a continuous flow of 0.5 bar low pressure operating water is supplied to the intermittent discharge system 10, valve 31 is closed and the OWM 27 is filled with water. No water of high pressure reaches the intermittent discharge system.

Between 0-5 s in the timeline of FIG. 4, the supplying 106 of liquid to the seal 13 is performed. In this time period an extra amount of operating water of high pressure is supplied to the paring chamber 12 via the supply line 202, i.e. valve 31 and valve 32 are open. During this time period of 5 s of supplying 106 of liquid to the seal 13, measuring 105 of the sub-atmospheric pressure in the space 3 and adjusting the sub-atmospheric pressure in the space 3 surrounding the centrifuge rotor 4 if the measured sub-atmospheric pressure is outside preset pressure interval ΔP are performed. Thus, the pressure is the space 3 is adjusted to be within preset pressure interval ΔP, such as adjusted to be at a set point pressure $P_{set}$ within the preset pressure interval ΔP. If the measured sub-atmospheric pressure in space 3 is higher than the set point pressure $P_{set}$, it is adjusted down to the set point pressure $P_{set}$. If the measured sub-atmospheric pressure in space 3 is below the set point pressure $P_{set}$, the pressure may not necessarily have to be actively adjusted. Instead, the pressure may increase in itself to be within the preset pressure interval ΔP or at the set point pressure $P_{set}$. This is because the pressure in the space 3 may increase due to part of the extra water supplied to the seal 13 evaporating and reaching the space 3 between the centrifugal rotor 4 and the frame 2. Evaporation may be caused by the low boiling point of the water at the low pressure in space 3.

After prefilling of water to the paring chamber 12, i.e. between 5-6 s in the timeline of FIG. 4, the valve 31 is yet again closed.

Discharge of a sludge phase 107 is initiated between 6-7 s in the timeline of FIG. 4. This may be performed by a pneumatic signal initiated by the control unit 21 and sent to a compressed air unit 203, which in turn forces a piston in the OWM 27 to push discharge water from the OWM 27 to the paring chamber 12. The pressure from the compressed air unit 203 affecting the piston in the OWM 27 may be adjusted depending on the signal initiated by the control unit 21. The control unit 21 may thus send a small discharge signal or a large discharge signal, wherein the small discharge signal gives rise to a smaller pressure from compressed air unit 203 than the large discharge signal. Thus, the small discharge signal gives rise to a smaller amount of water being pushed from the OWM 27 compared to amount of water being pushed from the OWM when the compressed air unit 203 receives the large discharge signal. The pneumatic signal from the control unit 21 and the pushing of the water to the paring chamber 12 by the OWM piston may continue for 5 s.

Between 8-10 s in the timeline of FIG. 4, valve 31 is opened and extra water of high pressure is supplied from supply line 202 to the paring chamber 12 to maintain the low pressure seal 13 arranged in the paring chamber 12.

Between 10-45 s in the timeline of FIG. 4, valve 32 is closed and only operating water of low pressure from supply line 201 reaches the paring chamber 12.

Between 12-45 s in the timeline of FIG. 4, valve 31 is open and valve 32 is closed so that the OWM 27 is refilled with operating water from the supply line 202 of operating water of high pressure.

At 46 s in the timeline of FIG. 4, the discharge is completed, valve 31 is closed and valve 32 is opened. Operating water of low pressure, such as water of 0.5 bar, is supplied from the supply line 201 to paring chamber 12.

Consequently, the discharging 107 of a separated sludge component from at least one sludge outlet 9 may comprise comprises initiating 107*a* intermittent discharge by supplying water to the intermittent discharge system from an operating water module 27 to open the peripheral ports 9;

supplying 107*b* liquid to the liquid seal 13 arranged in the paring chamber 12 for maintaining the seal; and refilling 107*c* the operating water module 27 with water.

From the description above follows that, although various embodiments of the invention have been described and shown, the invention is not restricted thereto, but may also be embodied in other ways within the scope of the subject-matter defined in the following claims.

The invention claimed is:

1. A method of operating a centrifugal separator, comprising:

supplying a liquid mixture to be separated to an inlet of the centrifugal separator, the separator comprising a frame which delimits a space that is sealed relative to the surroundings of the frame and in which a centrifuge rotor is arranged, and a drive member configured to rotate the centrifuge rotor in relation to the frame around an axis of rotation, wherein the centrifuge rotor encloses a separation chamber that is arranged to receive the supply of liquid mixture to be separated via the inlet, separating the liquid mixture into at least one separated liquid component and a separated sludge component;

discharging the at least one separated liquid component from at least one liquid outlet of the centrifuge rotor;

removing gas from the space surrounding the centrifuge rotor to obtain a sub-atmospheric pressure in the space; and discharging the separated sludge component from at least one sludge outlet arranged at the periphery of the centrifuge rotor to the space delimited by the frame, wherein the discharging is performed when the sub-atmospheric pressure in the space surrounding the centrifuge rotor is within a preset pressure interval ΔP;

wherein the method further comprises supplying liquid to a seal that seals the space relative to the surroundings of the frame before the discharging of the separated sludge component.

2. The method according to claim 1, wherein a difference between two end-values defining the pressure interval ΔP is less than 3 kPa.

3. The method according to claim 1, comprising measuring the sub-atmospheric pressure in the space surrounding the centrifuge rotor, and the discharging of the separated sludge component from the at least one sludge outlet being initiated when the measured sub-atmospheric pressure is within the preset pressure interval ΔP.

4. The method according to claim 3, wherein the measuring of the sub-atmospheric pressure in the space comprises adjusting the sub-atmospheric pressure in the space surrounding the centrifuge rotor, if the measured sub-atmospheric pressure is outside and above the preset pressure interval ΔP, wherein the adjusting is performed by removing gas from the space surrounding the centrifuge rotor until the measured sub-atmospheric pressure is within the preset pressure interval ΔP.

5. The method according to claim 4, wherein the measuring of the sub-atmospheric pressure in the space and the adjusting of the sub-atmospheric pressure in the space surrounding the centrifuge rotor, if the measured sub-atmospheric pressure is outside preset pressure interval ΔP, are performed during the supplying of the liquid to the seal that seals the space relative to the surroundings of the frame before the discharging of the separated sludge component.

6. The method according to claim 1, wherein the step of removing gas comprises removing gas such that the sub-atmospheric pressure fluctuates between a first lower sub-atmospheric pressure value P1 and a second higher sub-atmospheric pressure value P2, and wherein the preset pressure interval ΔP is smaller than the interval between the first (P1) and second (P2) pressure values.

7. The method according to claim 6, wherein the removing of gas is performed by a vacuum pump that operates in an active mode, in which the sub-atmospheric pressure is reduced to the pressure value P1, and an inactive mode, in which the sub-atmospheric pressure increases to the pressure value P2.

8. The method according to claim 7, wherein the measuring of the sub-atmospheric pressure in the space surrounding the centrifuge rotor and the discharging of the separated sludge component is initiated within a predetermined time interval Δt after the vacuum pump has been switched to its active mode, and wherein $\Delta t<10$ s.

9. The method according to claim 1, wherein the removing of gas from the space surrounding the centrifuge rotor and the discharging of the separated sludge component are repeated, and the volume of the discharged sludge component is, between each discharge, kept within 15% of a mean volume of the discharged sludge component.

10. The method according to claim 1, wherein the centrifugal separator comprises an intermittent discharge system for performing the step of discharging the separated sludge component, and wherein the seal is a liquid seal arranged in a paring chamber of the centrifugal separator, wherein the paring chamber further comprises at least one paring disc for supplying hydraulic fluid for operating the intermittent discharge system.

11. The method according to claim 10, wherein the discharging of the separated sludge component from the at least one sludge outlet comprises initiating intermittent discharge by supplying water to the intermittent discharge system from an operating water module to open the at least one sludge outlet;

supplying liquid to the liquid seal arranged in the paring chamber for maintaining a sealed state; and refilling the operating water module with water.

12. A centrifugal separator for separating a liquid mixture, the separator comprising:

a frame which delimits a space that is sealed relative to the surroundings of the frame and in which a centrifuge rotor is arranged, a drive member configured to rotate the centrifuge rotor in relation to the frame around an axis of rotation, wherein the centrifuge rotor encloses a separation chamber that is arranged to receive the supply of liquid mixture to be separated via an inlet and in which separation of the liquid mixture takes place during operation, at least one liquid outlet for discharging a separated liquid phase, at least one sludge outlet arranged at the periphery of the centrifuge rotor for intermittently discharging a separated sludge component to the space delimited by the frame, a pump device arranged for removing gas to obtain sub-atmospheric pressure in the space during operation, a measuring unit arranged to measure the sub-atmospheric pressure $P_x$ in the space during operation, and a control unit configured to receive a value of the sub-atmospheric pressure $P_x$ from the measuring unit, and to initiate discharge of the separated sludge component via the at least one sludge outlet when the received value $P_x$ is within a preset pressure interval $\Delta P$, and supply liquid to a seal that seals the space relative to the surroundings of the frame before initiating the discharge of the separated sludge component via the at least one outlet.

13. The centrifugal separator according to claim 12, wherein the pump device is a vacuum pump that operates in an active mode, in which the sub-atmospheric pressure is reduced to a pressure value P1, and an inactive mode, in which the sub-atmospheric pressure increases to a pressure value P2.

14. The centrifugal separator according to claim 13, comprising an intermittent discharge system for discharging the separated sludge component via the at least one sludge outlet, wherein the seal for sealing the space is arranged in a paring chamber of the centrifugal separator during operation, and the paring chamber comprises at least one paring disc for supplying hydraulic fluid for operating the intermittent discharge system.

* * * * *